United States Patent [19]

Yuh et al.

[11] Patent Number: 4,921,769

[45] Date of Patent: May 1, 1990

[54] PHOTORESPONSIVE IMAGING MEMBERS WITH POLYURETHANE BLOCKING LAYERS

[75] Inventors: Huoy-Jen Yuh, Pittsford, N.Y.; Beng S. Ong, Mississauga, Canada; John W. Spiewak, Webster; Constance J. Thornton, Ontario, both of N.Y.

[73] Assignee: Xerox Corporation, Stamford, Conn.

[21] Appl. No.: 252,959

[22] Filed: Oct. 3, 1988

[51] Int. Cl.[5] ..... G03G 5/14

[52] U.S. Cl. ..... 430/64; 430/58

[58] Field of Search ..... 430/64, 58

[56] References Cited

U.S. PATENT DOCUMENTS

| | | | |
|---|---|---|---|
| 2,901,348 | 3/1953 | Dessauer et al. | 96/1 |
| 3,713,821 | 6/1971 | Angelini | 96/1.5 |
| 3,879,199 | 4/1975 | Trubisky | 96/1.5 |
| 3,888,665 | 6/1975 | Wiedemann | 96/1.5 |
| 3,891,435 | 6/1975 | Lee | 96/1.5 |
| 3,907,650 | 9/1975 | Pinsler | 204/34 |
| 3,972,717 | 8/1976 | Wiedemann | 96/1.5 |
| 3,975,635 | 8/1976 | Lennon | 250/315 A |
| 4,010,031 | 3/1977 | Onishi et al. | 96/1 TE |
| 4,013,623 | 3/1977 | Turner et al. | 260/63 UY |
| 4,050,934 | 9/1977 | Turner | 96/1 R |
| 4,063,947 | 9/1977 | Pochan et al. | 96/1.5 N |
| 4,075,012 | 2/1978 | Turner et al. | 96/1 PC |
| 4,082,551 | 4/1978 | Steklenski et al. | 96/1 PC |
| 4,106,935 | 8/1978 | Petruzzella | 96/1.5 R |
| 4,264,695 | 4/1981 | Kozima | 430/58 |
| 4,391,888 | 7/1983 | Chang et al. | 430/57 |
| 4,415,639 | 11/1983 | Horgan | 430/57 |
| 4,465,751 | 8/1984 | Kawamura et al. | 430/64 |
| 4,474,865 | 10/1984 | Ong et al. | 430/58 |
| 4,582,773 | 4/1986 | Johncock et al. | 430/65 |
| 4,673,628 | 6/1987 | Inoue | 430/58 |

*Primary Examiner*—J. David Welsh

*Attorney, Agent, or Firm*—E. O. Palazzo

[57] ABSTRACT

An imaging member comprised of an optional supporting substrate; a ground plane layer; a blocking layer; an optional adhesive layer; a photogenerator layer; and a charge transport layer, wherein the blocking layer is comprised of a polyurethane of the formula:

wherein A is a trivalent group; A′ is a bivalent group; R is selected from the group consisting of alkylene, substituted alkylene, arylene, and substituted arylene; x and y are number mole fractions the sum of which is equal to 1.0.

39 Claims, 6 Drawing Sheets

PHOTORESPONSIVE IMAGING MEMBERS WITH POLYURETHANE BLOCKING LAYERS

BACKGROUND OF THE INVENTION

This invention is generally directed to imaging members, and more specifically the present invention relates to the selection of certain polyurethanes which function as charge blocking layers for photoresponsive imaging members, especially seamless organic imaging members. In one embodiment, the present invention relates to an imaging member comprised of a supporting substrate, a conductive ground plane, a charge blocking layer comprised of a urethane polymer, an adhesive layer, a photogenerator, and a charge transport layer. Also, in another embodiment of the present invention, there are provided seamless imaging members comprised of a hole transport layer, a photogenerating layer, an adhesive layer, a hole blocking layer comprised of a urethane polymer, and a conductive supporting substrate. The aforementioned imaging members are useful in electrophotographic printing and imaging processes, and in particular, can be selected for the generation of latent images in electrostatic imaging systems. With further regard to the imaging members of the present invention, the primary function of the hole blocking layer is to prevent dark injection of charge carriers from the ground plane or conductive substrate into the photogenerating layer, thus significantly reducing the dark decay characteristics of imaging members.

Layered imaging members with blocking layers are known, especially those wherein the blocking layer is comprised of a metal oxide, or a siloxane, reference U.S. Pat. No. 4,464,450.

Illustrated in U.S. Pat. No. 4,562,132, the disclosure of which is totally incorporated herein by reference, entitled Photoresponsive Imaging Members Containing Electron Transport Overcoatings, are imaging members comprised of a supporting substrate, a hole transport layer comprised of an aryl amine hole transporting compound dispersed in an inactive resinous binder, a photogenerating layer comprised of a photogenerating pigment optionally dispersed in a resinous binder, and as a protective topcoating an electron transporting compound of the following formula dispersed in a resinous binder

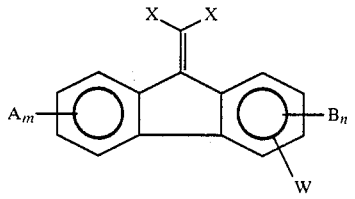

where X is cyano or alkoxycarbonyl groups, A and B are electron withdrawing groups, m is a number of from 0 to 2, n is the number 0 or 1, and W is an electron withdrawing group selected from the group consisting of acyl (COR), alkoxycarbonyl (COOR), alkylaminocarbonyl (CONHR), and derivatives thereof.

Moreover, illustrated in copending application U.S. Ser. No. 882,117, entitled Phoresponsive Imaging Members With Electron Transport Overcoatings, the disclosure of which is totally incorporated herein by reference, are inorganic photoresponsive imaging members having incorporated therein as protective overcoatings polycondensation polymers derived from the polycondensation of 2,2-bis(hydroxymethyl)-butyl 9-dicyanomethylene-fluorene-4-carboxylate, and diisocyanate. Also disclosed in the copending application are layered photoresponsive imaging members comprised of a supporting substrate, a photoconductive layer, an arylamine hole transport layer, and a protective overcoating layer comprised of the aforementioned polyurethane polymers. In addition, the polyurethane polymers of the copending application are useful as the top overcoating for positive-charging layered photoresponsive devices comprised of a supporting substrate, a hole transport layer, and a photoconductive layer, and wherein the polymers are of the following formula

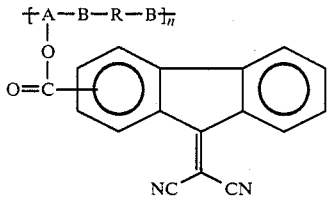

wherein A is a trivalent linkage; B is a functional group such as an ester (—OCO—), a carbonate (—OCOO—) or a carbamate (—OCONH—); R is a bivalent group, and n represents a certain number of repeating units.

The polyurethanes of the present invention are somewhat similar to the aforementioned polyurethane coatings. More specifically, the polyurethanes of the present invention contain therein certain highly flexible segments, thereby providing the desired flexibility characteristic useful for application in the belt-type imaging devices. Furthermore, the presence of the soft flexible segments in the polyurethanes of the present invention greatly improve their solubilities in common coating solvents such as aromatic hydrocarbons, tetrahydrofuran, chlorinated hydrocarbons, and the like, thereby enabling the coating process to be accomplished in a variety of solvents by different coating techniques, such as dip coating, spray coating, and the like. More importantly, the incorporation of the flexible segments into the polyurethane structure renders the synthesis of higher molecular-weight polyurethanes feasible, thus affording mechanically strong and highly durable polyurethane blocking layers. The polyurethanes of the present invention also display good adhesion properties, thereby improving the adhesion of the generator layer to the ground plane.

Also, in U.S. Pat. No. 4,820,601, the disclosure of which is totally incorporated herein by reference, there are illustrated imaging members with protective overcoatings comprised of the copolyurethanes selected as blocking layers for the same, or similar imaging members of the present invention.

There are disclosed in U.S. Pat No. 4,474,865 improved photoresponsive imaging members with electron transporting components containing specific dicyano fluoro ester moieties; U.S. Pat. No. 3,928,034, which illustrates the incorporation of electron transporting moieties chemically attached to polymers, reference columns 7 and 8; and U.S. Pat. Nos. 4,007,043; 4,063,947; 4,075,012; and 3,896,184. Also of interest are U.S. Pat. Nos. 3,108,092; 3,451,969; 4,063,947; and 4,203,764; and Holland Patent Publication No. 7606525. Of particular interest are U.S. Pat. No. 4,063,947 and Holland Patent Publication No. 7606525, which disclose imaging members with electron transport compounds, reference column 3, line 57, to column 4, line 30, of the '947 patent; U.S. Pat. Nos. 3,907,650, which discloses hole transport materials for an electron blocking layer reference column 3; U.S. Pat. No. 3,975,635, which discloses a xeroradiographic plate with a conductive backing member, an overlayer of selenium, and an intermediate layer of polyvinyl carbazole or an alloy of arsenic and selenium; U.S. Pat. No. 4,582,773 illustrating electrophotographic photoreceptors including a blocking layer formed from a doped microcrystalline semiconductor alloy; and U.S. Pat. Nos. 4,013,623; 4,050,934, which disclose a dicyanomethylene group as the electrical active moiety for use in electron transporting layer. Other patents of background interest are U.S. Pat. No. 4,465,751, which mentions cuprous iodide as a conductive substrate film; U.S. Pat. Nos. 2,901,348; 3,713,821; 3,879,199; 3,888,665; 3,891,435; 3,972,717; 4,010,031; 4,082,551; 4,106,935; 4,391,888; and 4,415,639.

While the above-described imaging members particularly those disclosed in the copending applications, and U.S. Pat No. 4,820,601, are suitable for their intended purposes, there continues to be a need for layered photoresponsive imaging members with functionally superior charge blocking layers. More specifically, there continues to be a need for charge blocking layers which can effectively block the dark injection of charge carriers from the ground plane into the photogenerating layer. Additionally, there continues to be a need for charge blocking layers with excellent flexibility characteristics, thereby enabling their use in belt-type organic imaging members. Furthermore, there is a need for organic charge blocking layer materials which are soluble in a variety of solvents thereby permitting improved coatability, and allowing economical spray and dip coating processes to be selected for the preparation thereof. Another need resides in the provision of charge blocking layers with acceptable desirable adhesive properties enabling the layer to adhere to the ground plane or conductive substrate, thereby improving the overall layered lamination integrity of the imaging members.

SUMMARY OF THE INVENTION

It is an object of the present invention to provide an improved photoresponsive imaging member with many of the advantages illustrated herein.

In a further object of the present invention there are provided polyurethane charge blocking layers for photoresponsive imaging members.

In another object of the present invention there are provided organic belt-type photoresponsive imaging members with a hole transport layer, a photogenerating layer, an adhesive layer, a charge blocking layer of copolyurethanes, and a conductive substrate.

In yet a further object of the present invention there are provided layered photoresponsive imaging members containing as a charge blocking layer specific polyurethanes, which layers are insulating and not conductive or leaky to charges in the dark.

In still another object of the present invention there are provided photoresponsive imaging members with charge blocking layers of novel polyurethanes.

Another object of the present invention resides in the provision of temperature and humidity insensitive polyurethane charge blocking layers for organic seamless photoresponsive imaging members.

Additionally, another object of the present invention resides in the provision of polymeric charge blocking layers for photoreceptors, which layers are environmentally safe, and are inert to the users of the devices.

Moreover, in another object of the present invention there are provided organic seamless photoconductive imaging members with charge blocking layers of the polyurethanes illustrated herein, which layers enhance the useful service life of the imaging members.

Another object of the present invention is to provide effective charge blocking layers for layered photoresponsive imaging members, thereby improving the performance of the imaging members by significantly reducing their dark decay characteristics.

These and other objects of the present invention are accomplished by the provision of photoresponsive imaging members having incorporated therein as charge blocking layers certain polyurethanes. More specifically, in one embodiment of the present invention there are provided photoresponsive imaging members having incorporated therein as charge blocking layers polyurethanes of the formula

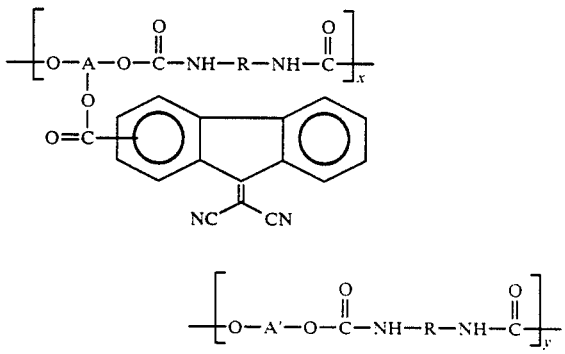

wherein A is a trivalent group such as dimethylene alkyl group, or triethylene amine; A′ is a bivalent group such as alkylene, arylene, polyether segments, and the derivatives thereof; R is selected from the group consisting of alkylene, arylene, and the derivatives thereof; and x and y are number mole fractions wherein the sum thereof is equal to 1. More specifically, x and y are a number of mole fractions of from about 0.05 to about 0.95. The aforementioned polyurethanes and the preparation thereof are illustrated in the aforementioned U.S. Pat. No. 4,820,601, the disclosure of which is totally incorporated herein by reference.

Examples of polyurethanes selected as the charge blocking layer include those as represented by the following Formulas I, II and III:

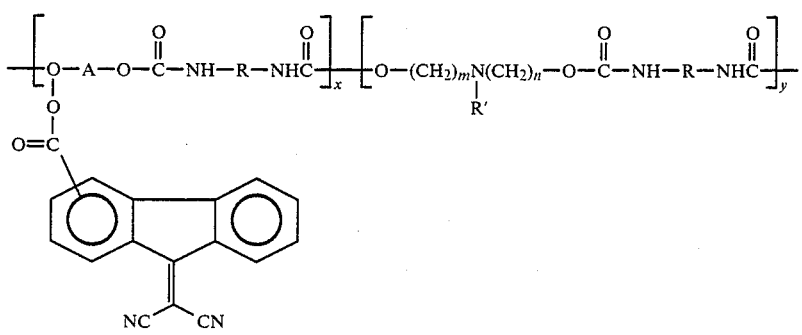

(I)

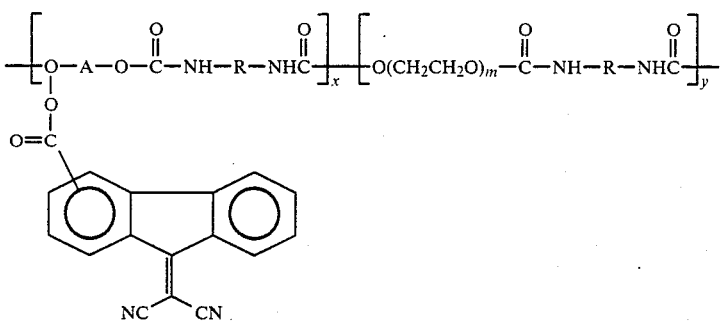

(II)

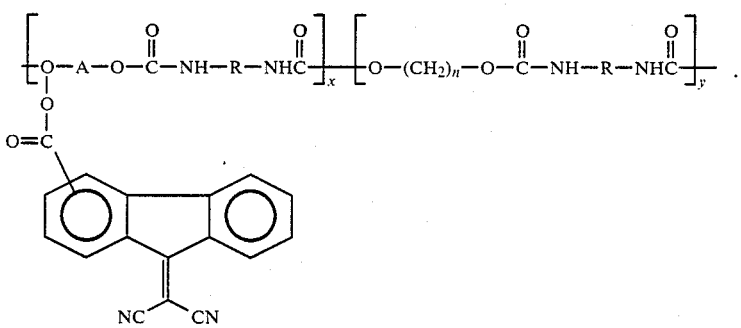

(III)

wherein A is a trivalent group; R is a bivalent group such as alkylene, arylene, substituted alkylene or substituted arylene group such as methylene, dimethylene, trimethylene, tetramethylene, phenylene, tolylene, and the like; R′ is an alkyl, or substituted alkyl substituent, an aryl or substituted aryl substituent; x and y represent number mole fractions of from about 0.05 to about 0.95 subject to the provision that the sum of x+y is equal to 1.0; and m and n are positive integers of from 1 to about 20. Examples of alkyl substituents include those with from about 1 to about 25 carbon atoms, such as methyl, ethyl, propyl, butyl, pentyl, dodecyl, and the like; while examples of aryl substituents are those with from about 6 to about 24 carbon atoms, such as phenyl and naphthyl.

Specifically, examples of polyurethane polymers selected for the imaging members of the present invention include those represented by the formulas illustrated in FIGS. 1 to 10, wherein the substituents such as x and y are as defined herein.

The polyurethanes of the present invention can be synthesized, reference Reaction Scheme 1 that follows, by the reaction of the dihydroxy-functionalized monomer (1*a*) and a diol (2) such as ethylene glycol, diethylene glycol, octanediol, and the like, with a slight excess of diisocyanate (3) in an inert reaction solvent medium at a temperature usually below 100° C., and preferably between 50° C. to 85° C. In general, a suitable catalyst such as tertiary amines, dibutyltin diacetate or dibutyltin dilaurate can be employed to increase the rate of polymerization.

SCHEME 1

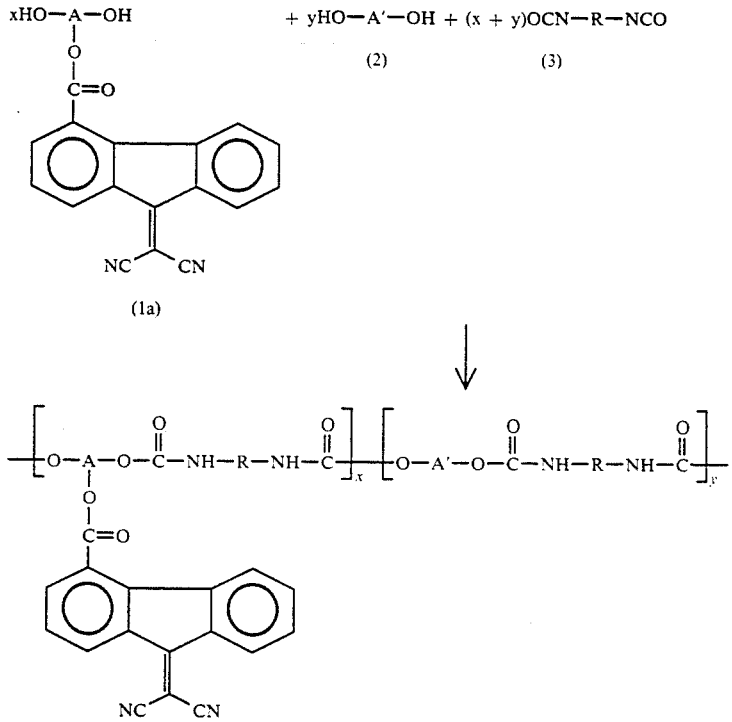

wherein A, A', x, y, and R are as illustrated herein.

Examples of suitable solvents for the above polymerization reaction include ethyl acetate, tetrahydrofuran, dioxane, dimethyl sulfoxide, dimethyl acetamide, and dimethylformamide. Also, the aforesaid reaction is generally accomplished in a period of from about 2 to about 24 hours depending on the nature of the reagents and reaction conditions.

Examples of diisocyanates that may be selected for the preparation of the copolyurethanes include methane diisocyanate, 1,2-ethane diisocyanate, 1,3-propane diisocyanate, 1,6-hexane diisocyanate, 1,4-cyclohexane diisocyanate, 1,4-dimethylenecyclohexane diisocyanate, benzene diisocyanate, toluene diisocyanates, methylene bis(4-phenyl isocyanate), and the like.

Specific examples of the dihydroxy-functionalized monomer (1a) selected for the preparation of the polyurethanes include

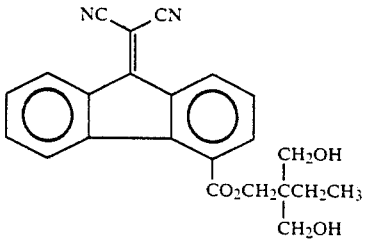

2,2-bis(hydroxymethyl)butyl9-dicyanomethylenefluorene-4-carboxylate;

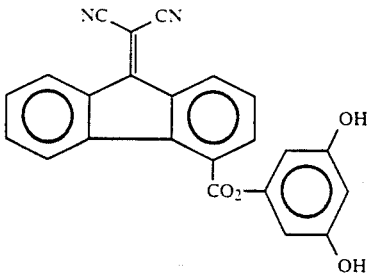

3,5-dihydroxyphenyl9-dicyanomethylenefluorene-4-carboxylate;

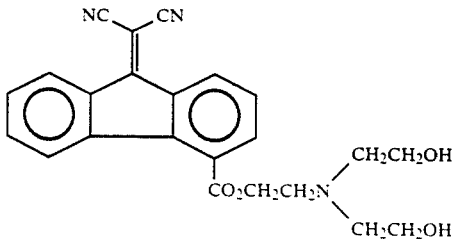

2[bis(2-hydroxyethyl)amino]ethyl 9-dicyanomethylenefluorene-4-carboxylate;

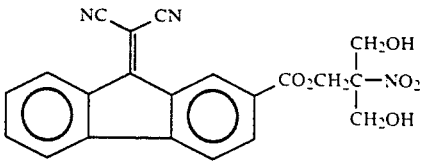

3-hydroxy-2-nitro-2-hydroxymethylpropyl 9-dicyanomethylenefluorene-4-carboxylate;

(e)

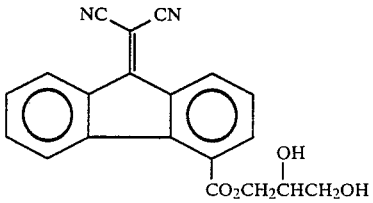

2,3-dihydroxypropyl9-dicyanomethylenefluorene-4-carboxylate;

(f)

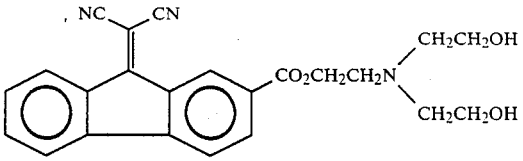

2-[bis(2-hydroxyethyl)amino]ethyl 9-dicyanomethylenefluorene-4-carboxylate; and (g)

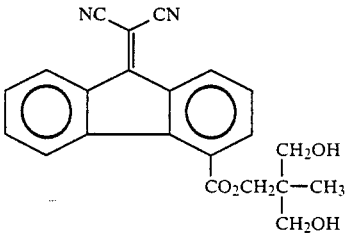

2,2-bis(hydroxymethyl)propyl9-dicyanomethylenefluorene-4-carboxylate.

The polyurethanes illustrated herein and synthesized, for example, in accordance with the processes specified can be characterized by various analytical techniques including spectroscopy, GPC, vapor pressure osmometry, and the like. Also, the polyurethane can be applied to the imaging members disclosed herein in a thickness that will enable the objectives of the present invention to be achieved. Generally, the thickness of this layer is from about 0.01 micron to about 2 microns, and preferably from about 0.1 micron to about 2 microns.

BRIEF DESCRIPTION OF THE DRAWINGS

The invention will now be illustrated with reference to specific preferred embodiments wherein.

DESCRIPTION OF THE PREFERRED EMBODIMENTS

Figure 11:
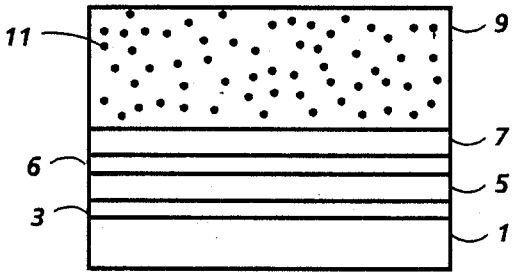
FIG. 11 represents a cross-sectional view of a photoresponsive imaging member of the present invention.

There is illustrated in FIG. 11 a photoresponsive imaging member of the present invention comprised of an optional supporting substrate 1, such as aluminum; a ground plane layer 3 of a thickness of from about 0.1 micron to 150 microns of, for example, a copper iodide, or a carbon black dispersion in a suitable binder such as poly(vinyl fluoride), polyesters, and the like; a charge blocking polyurethane layer 5 of the formulas illustrated herein of a thickness of from about 0.001 micron to about 25 microns, and preferably 0.1 to about 3 microns; an optional adhesive layer 6 of a thickness of from about 0.001 micron to 0.5 micron; a photogenerator layer 7 of a thickness of 0.1 micron to 2 microns; and a charge transport layer 9 of a thickness of from about 5 microns to 50 microns dispersed in an inactive resinous binder 11.

Figure 3:
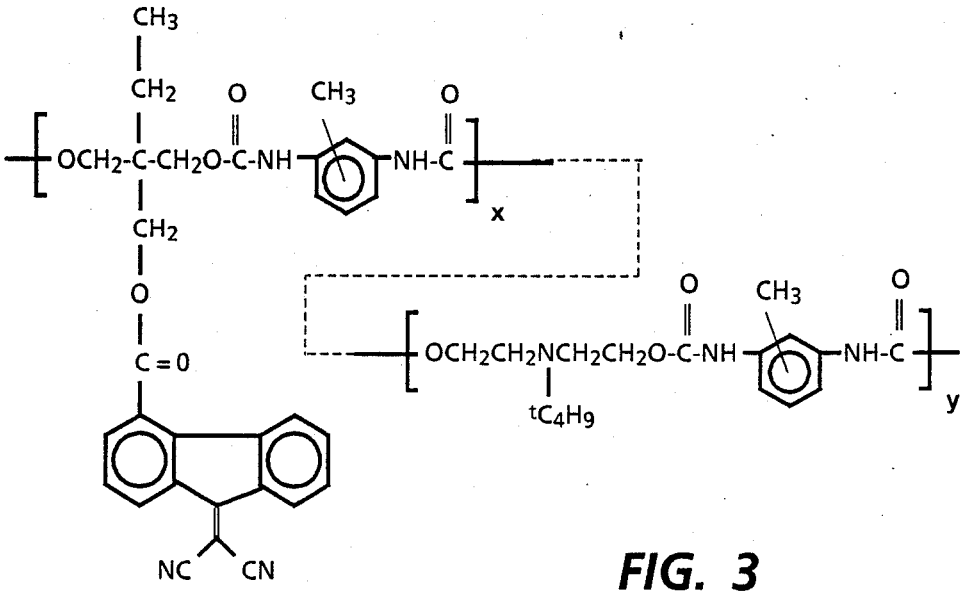
Figure 12:
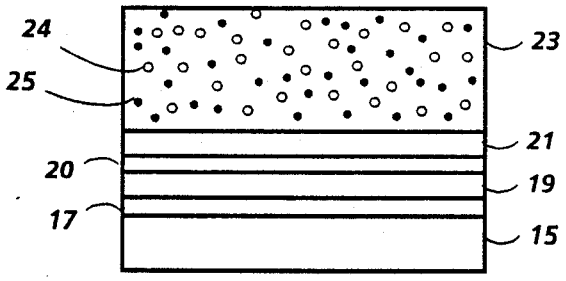
FIG. 12 represents a cross-sectional view of a preferred photoresponsive imaging member of the present invention.

Illustrated in FIG. 12 is a photoresponsive imaging member of the present invention comprised of a polymeric substrate 15; a ground plane layer 17 comprised of copper iodide of a thickness of about 0.05 micron; a blocking layer 19 of a thickness of about 0.3 micron comprised of the polyurethane of FIG. 3 illustrated herein, and derived from the polycondensation of 2,2-bis(hydroxymethyl)butyl 9-dicyanomethylenefluorene-4-carboxylate and t-butyl bis(2-hydroxyethyl)amine with toluene diisocyanates; an adhesive layer 20 comprised of a polyester, such as PE49000 available from Goodyear Chemical, phenoxy resins, silicon polymers, vinyl polymers, and the like of a thickness of about 0.05 micron; a photogenerator layer 21 comprised of trigonal selenium of a thickness of about 0.8 micron; and an aryl amine hole transport layer 23 of thickness of about 30 microns comprised of a diamine 24 such as N,N'-diphenyl-N,N'-bis(3-methyl phenyl) 1,1'-biphenyl-4,4'-diamine dispersed in an inactive resinous binder 25.

With further reference to the photoresponsive imaging members illustrated herein, and particularly with reference to FIGS. 11 to 12, the supporting substrate layers may be comprised of any suitable material having the requisite mechanical properties. Thus, the substrate layers, usually of a thickness of from about 50 to about 5,000 microns, may be comprised of a layer of polymeric materials such as the commercially available Mylar, polyesters, polyurethanes, polyamides, and the like. The substrate may be flexible or rigid, and may be of a number of many different configurations such as, for example, a plate, a cylindrical drum, a scroll, an endless flexible belt, and the like. Preferably, the substrate is in the form of an endless flexible belt or a rigid drum.

The photoconductive, or photogenerating layers of the imaging members of the present invention, reference for example the members of FIGS. 11 and 12, can be comprised of known photoconductive materials usually of a thickness of from about 5 to about 35 microns including, for example, amorphous selenium, amorphous selenium alloys, halogen-doped amorphous selenium, halogen-doped amorphous selenium alloys, trigonal selenium, selenide and carbonates with trigonal selenium, reference U.S. Pat. Nos. 4,232,102 and 4,233,283, the disclosures of which are totally incorporated herein by reference; cadmium sulfide, cadmium selenide, cadmium telluride, cadmium sulfur selenide, cadmium sulfur telluride, cadmium seleno telluride, copper and chlorine-doped cadmium sulfide, and the like. Alloys of selenium included within the scope of the present invention are selenium tellurium alloys, selenium arsenic alloys, selenium tellurium arsenic alloys, and preferably such alloys containing selenium in an amount of from about 70 to about 99.5 percent by weight and an optional halogen material, such as chlorine, in an amount of from about 50 to about 200 parts per million. Also, this layer can be comprised of metal phthalocyanines, metal free phthalocyanines, reference U.S. Pat. No. 4,265,990, the disclosure of which is totally incorporated herein by reference; other known phthalocyanines as disclosed in U.S. Pat. No. 3,816,118, the disclosure of which is totally incorporated herein by reference; vanadyl phthalocyanine, squaraines, perylenes, and the like.

Examples of known ground plane layers include inorganic materials such as, for example, aluminum, chromium, nickel, brass, copper iodide, and the like; conductive polymer materials such as aluminized Mylar; or carbon black impregnated polymer films.

Various hole transport layer compositions can be selected providing these substances are capable of transporting holes, this layer generally having a thickness in the range of from about 5 to about 50 microns, and preferably from about 20 to about 40 microns. Thus, the transport layer comprises aryl amine molecules of the formula

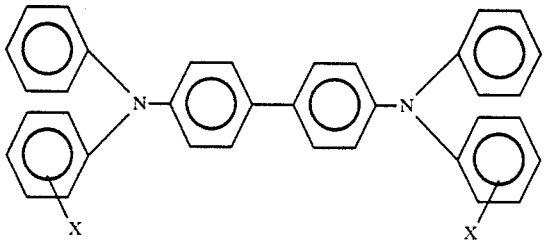

dispersed in a highly insulating and transparent organic resinous material such as polycarbonates and the like as illustrated in, for example, the '132 patent wherein X is selected from the group consisting of alkyl and halogen, preferably methyl and chlorine. The charge transport layer is substantially nonabsorbing in the spectral region of intended use, that is, visible light, but is "active" in that it allows injection of photogenerated holes from the charge generator layer. Also, the resin becomes electrically active when it contains from about 10 to 75 weight percent of the substituted N,N,N',N'-tetraphenylbenzidine corresponding to the foregoing formula. Compounds corresponding to this formula include, for example, N,N'-diphenyl-N,N'-bis-(alkylphenyl)benzidine wherein alkyl is selected from the group consisting of methyl, ethyl, propyl, butyl, hexyl, N,N'-diphenyl-N,N'-bis(3-methylphenyl)benzidene; N,N'-diphenyl-N,N'-bis(3-methylphenyl)1,1'-biphenyl-4,4'-diamine; and the like. With halogen substitution, the compound is N,N'-diphenyl-N,N'-bis(halophenyl)-benzidene.

Other electrically active small molecules which can be dispersed in the electrically inactive resin to form a layer which will transport holes include triphenylamine, bis-(4-diethylamino-2-methylphenyl)phenyl methane, and bis-(4-diethylaminophenyl)phenylmethane.

Several advantages are associated with the imaging members of the present invention inclusive of enabling the generation of images with excellent resolution, and no background deposits for an extended number of imaging cycles exceeding, for example 200,000; and moreover, the members, especially seamless photoresponsive members with the carbon black impregnated transparent ground planes, can be irradiated from behind the polyurethane ground plane,thus providing certain enabling architectural advantages such as permitting the incorporation of an erase lamp inside the photoreceptor loops. Furthermore, the addition of a charge blocking layer in combination with the polyurethane blocking layer improves the acceptance potential while effectively reducing the dark conductivity of the imaging members, thus enabling the members to easily achieve acceptable desirable contrast potentials with relatively low or no background deposits. The presence of the blocking layer also enhances the resistance of the imaging members to environmental changes, such as changes in humidity and temperature. These changes generally have an adverse effect on the electrical performance of photoresponsive imaging members giving rise to high dark conductivity and high residual potentials. These undesired electrical effects usually result in poor copy quality such as faint images with high backgrounds. Also, the sensitivity of the imaging member to humidity and temperature would render the copy quality dependent on the environmental conditions.

With further respect to the present invention, there are envisioned imaging and printing processes wherein, for example, an electrostatic latent image is generated on the imaging members illustrated herein subsequently rendering the image visible with a developer composition comprised of a toner with resin particles such as styrene polymers, pigment particles such as carbon black, charge enhancing additives such as cetyl pyridinium chloride, external additives such as colloidal silicas and metal salts, and metal salts of fatty acids inclusive of zinc stearate, reference for example U.S. Pat. Nos. 4,298,672; 4,338,390; 4,560,635; 3,590,000; 3,900,588; 3,983,045; and copending applications U.S. Ser. Nos. 136,792 and 136,791, the disclosures of each of the aforementioned patents and applications being totally incorporated herein by reference; thereafter transferring the developed image to a suitable substrate such as paper; and permanently affixing the image thereto by, for example, heat or other similar processes.

The invention will now be described in detail with respect to specific preferred embodiments thereof, it being understood that these examples are intended to be illustrative only and the invention is not intended to be limited to the materials, conditions, and process parameters recited herein. All percentages and parts are by weight unless otherwise indicated.

EXAMPLE I

Synthesis of 2,2-bis(hydroxymethyl)butyl 9-dicyanomethylenefluorene-4-carboxylate (a)

A mixture of 2.1 kilograms of trimethylolpropane, 173 grams of fluorenone-4-carboxylic acid, and 8 milliliters of sulfuric acid was mechanically stirred and heated in a 5-liter flask at 100° C. for 5 hours. The mixture was cooled to about 80° C., and 1 liter of methanol was added. Thereafter, the resulting solution was poured slowly into 17 liters of 3 percent aqueous sodium bicarbonate solution with constant stirring, and the crude product resulting was filtered, washed several times with water, and dried. Purification by recrystallization from ethyl acetate afforded 187 grams of pure 2,2-bis(hydroxymethylbutyl)fluorenone-4-carboxylate, m.p., 134° to 135.5° C.

A solution of 240 grams of the ester as obtained above, 93 grams of malononitrile, and 5 milliliters of piperidine in 2.3 liters of absolute methanol was heated under reflux in a nitrogen atmosphere for 5 hours. After the reaction, the mixture was cooled to about 50° C., and the solid product was filtered. The product obtained of Formula (a) was washed twice with methanol, dried in vacuo at 100° C. to afford 229 grams of pure (a), m.p., 208° to 209° C.

| Analysis Calculated for | |
|---|---|
| $C_{23}H_{20}N_2O_4$: | C, 71.12; H, 5.19; N, 7.12 |
| Found | C, 71.23; H, 5.21; N, 7.13 |
| IR (KBr), $cm^{-1}$: | 3,420; 2,230; 1,730. |
| $^1H$ MNR (DMSO-$d_6$), ppm: | 0.85 (t, 3H); 1.4 (q, 2H); 3.4 (d, 4H); 4.3 (s, 2H); 4.4 (t, 2H); 7.4 to 8.6 (m, 7H). |

EXAMPLE II

Synthesis of 3,5-dihydroxyphenyl 9-dicyanomethylenefluorene-4-carboxylate (b)

A solution of 30.0 grams of phloroglucinol and 70 milliliters of pyridine in 300 milliliters of dichloromethane was stirred at room temperature under a nitrogen atmosphere. Thereafter, a solution of 8.0 grams of (4-chloroformyl-9-fluorenylidene)malononitrile in 400 milliliters of dichloromethane was added thereto over a period of 1 hour. After addition, the reaction mixture was further stirred for another hour. The mixture was washed three times with dilute aqueous HCl solution, twice with dilute aqueous $NaHCO_3$ solution, and once with water. The solution was dried, filtered, and evaporated under reduced pressure to give the crude product. Recrystallization from methanol afforded 6.1 grams of (b), m.p., 255.5° to 257° C.

| Analysis Calculated for | |
|---|---|
| $C_{23}H_{12}N_2O_4$: | C, 72.63; H, 3.18; N, 7.37 |
| Found: | C, 72.41; H, 3.12; N, 7.17 |
| IR (KBr), $cm^{-1}$: | 3,410; 2,230; 1,730. |
| $^1H$ MNR (acetone-$d_6$), ppm: | 3.25 (br s, 2H); 6.8 (s, 3H); 7.6 to 9.0 (m, 7H). |

EXAMPLE III

Synthesis of 2-[bis(2-hydroxyethyl)amino]ethyl 9-dicyanomethylene fluorene-4-carboxylate (c)

A solution of 100.0 grams of triethanolamine and 58 milliliters of dry pyridine in 350 milliliters of dry dichloromethane was stirred at room temperature under a nitrogen atmosphere. Thereafter, a solution of 8.0 grams of (4-chloroformyl-9-fluorenylidene)malononitrile in 400 milliliters of dry dichloromethane was added over a period of 1 hours. After addition, the reaction mixture was further stirred for another hour. The reaction mixture was washed several times with water to remove the excess amines and the corresponding hydrochloride salts, dried with anhydrous magnesium sulfate, and filtered. Evaporation of the filtrate provided 5 grams of crude product. Purification by recrystallization from isopropanol afforded 4.5 grams of pure (c), m.p., 155.5° to 156.5° C.

| Analysis Calculated for | |
|---|---|
| $C_{23}H_{21}N_3O_4$: | C, 68.48; H, 5.25; N, 10.42 |
| Found | C, 68.31; H, 5.33; N, 10.35 |
| IR (KBr), $cm^{-1}$: | 3,360; 2,225; 1,730. |
| $^1H$ MNR (DMSO-$d_6$), ppm: | 2.6 (t, 4H); 2.8 (t, 2H); 3.25 (br s, 2H); 3.4 (t, 4H); 4.4 (t, 2H); 7.4 to 8.6 (m, 7H). |

-continued

Other hydroxy carboxylates can be prepared in a manner similar to Examples I and III.

EXAMPLE IV

Figure 1:
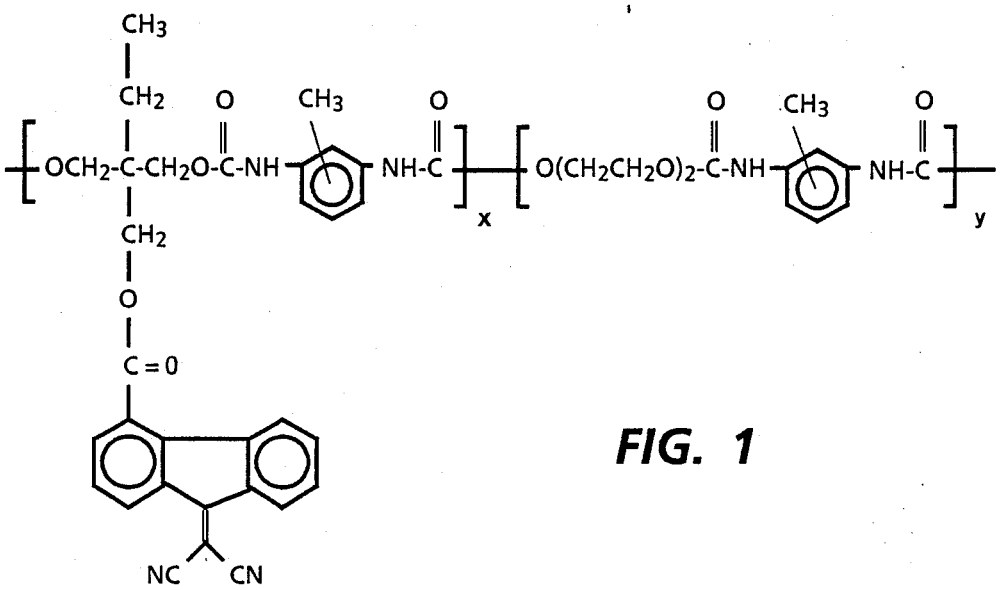
FIGS. 1 through 10 are formulas representing polyurethanes charge blocking layers for the imaging members of the present invention.

Synthesis of Copolyurethane (FIG. 1, x+0.5; y+0.5)

A mixture of 0.030 mole of diol monomer (a), 0.030 mole of diethylene glycol, 0.063 mole of toluene diisocyanates (mixture of 2,4- and 2,6-diisocyanates), and 0.05 gram of dibutyltin dilaurate was dissolved in 100 milliliters of dried dimethyl sulfoxide. The mixture was heated under an inert atmosphere at 70° to 75° C. for 4 hours, after which 5 milliliters of ethanol were added. Thereafter, the reaction mixture was heated for another hour before cooling down to room temperature. This mixture was then poured slowly into 3 liters of swirling methanol to precipitate the resultant polyurethane. The polyurethane product was filtered and washed twice with 500 milliliters of methanol. The yield of the above copolyurethane with the formula as represented by FIG. 1 was 86 percent after drying in vacuo at 65° C. for 24 hours; DP (degree of polymerization) was 103; Tg 121° C. (midpoint); IR (KBr) 1,729; 2,221 $cm-^1$.

EXAMPLE V

Synthesis of Copolyurethane (FIG. 1, x+0.6; y+0.4)

The copolyurethane of FIG. 1 above was prepared according to the procedure of Example IV with the exceptions that 0.036 mole of diol monomer (a), 0.024 mole of diethylene glycol, and 0.063 mole of toluene diisocyanates were employed; and the reaction was conducted for 6 hours. The yield was 88 percent; DP 112; and Tg 134° C.; IR (KBr) 1,730; 2,221 $cm-^1$.

EXAMPLE VI

Synthesis of Copolyurethane (FIG. 3, x+0.5; y+0.5)

A mixture of 0.150 mole of diol monomer (a), 0.150 mole of t-butyl bis(2-hydroxyethylamine), and 0.316 mole of tolylene diisocyanates, and 0.2 gram of dibutyltin dilaurate in 700 milliliters of dried dimethylsulfoxide was heated under a nitrogen atmosphere at 70° to 75° C. for 10 hours. Subsequently, 10 milliliters of absolute ethanol was added and the reaction was continued at the same temperature for another hour. After cooling down to room temperature, the reaction mixture was poured into 5 liters of methanol to precipitate the above polyurethane product. The precipitate was filtered, washed with methanol, and dried in vacuo at 60° C. for 24 hours. The yield of the above copolyurethane was 91 percent; DP 121; and Tg 134° C.; IR (KBr) 1,730; 2,222 $cm -^1$.

EXAMPLE VII

Figure 4:
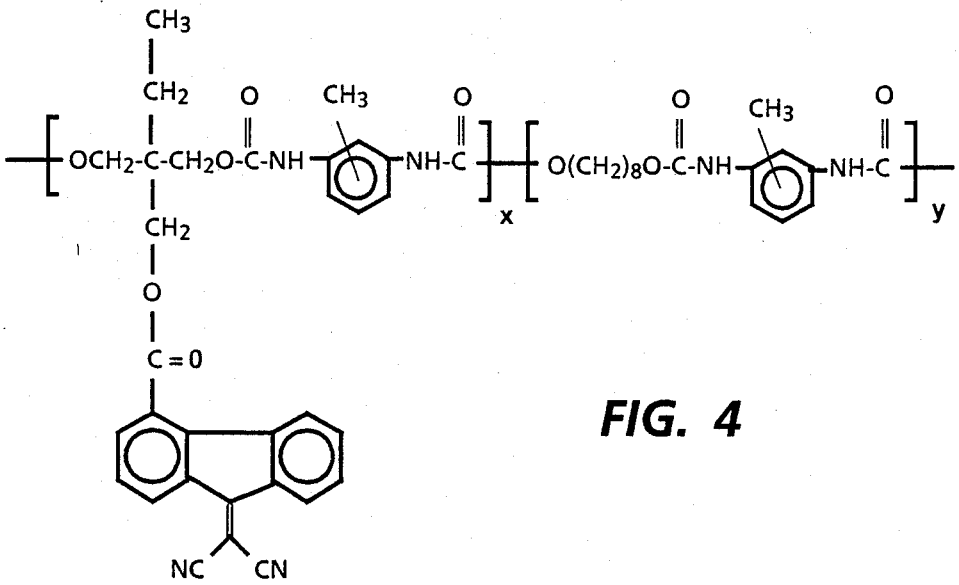
Figure 5:
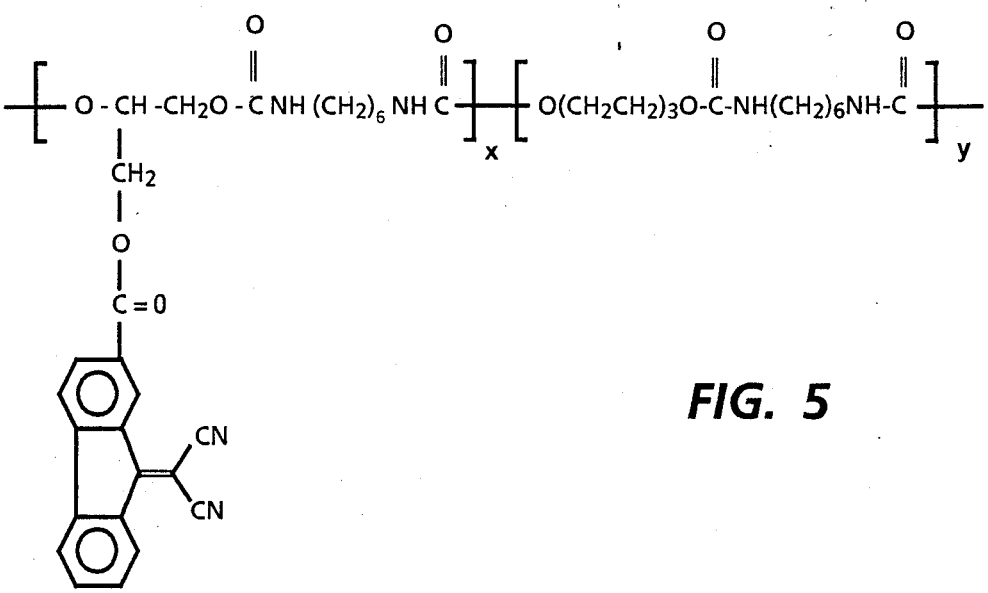

Synthesis of Copolyurethane (FIG. 4, x+0.5; y+0.5)

The synthesis of the above copolyurethane was accomplished in accordance with the procedure of Example VI with a mixture of 0.030 mole of diol monomer (a), 0.030 mole of 1,8-octanediol, 0.063 mole of toluene diisocyanates, and 0.05 gram of dibutyltin dilaurate. The yield of the above copolyurethane was 84 percent; DP 99; Tg 118° C.; IR (KBr) 1,730; 2,222 $cm-^1$.

EXAMPLE VIII

Figure 6:
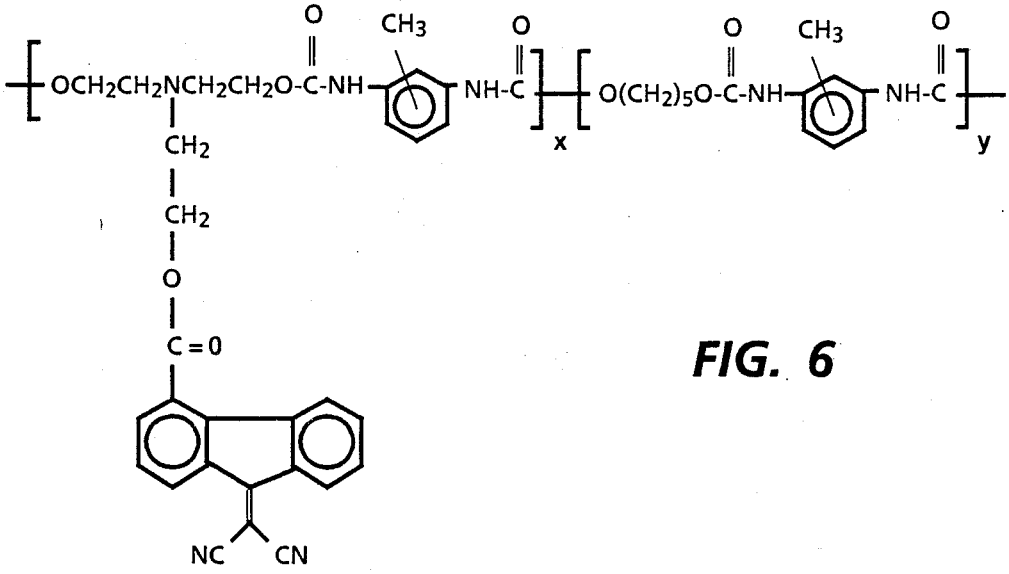
Figure 7:
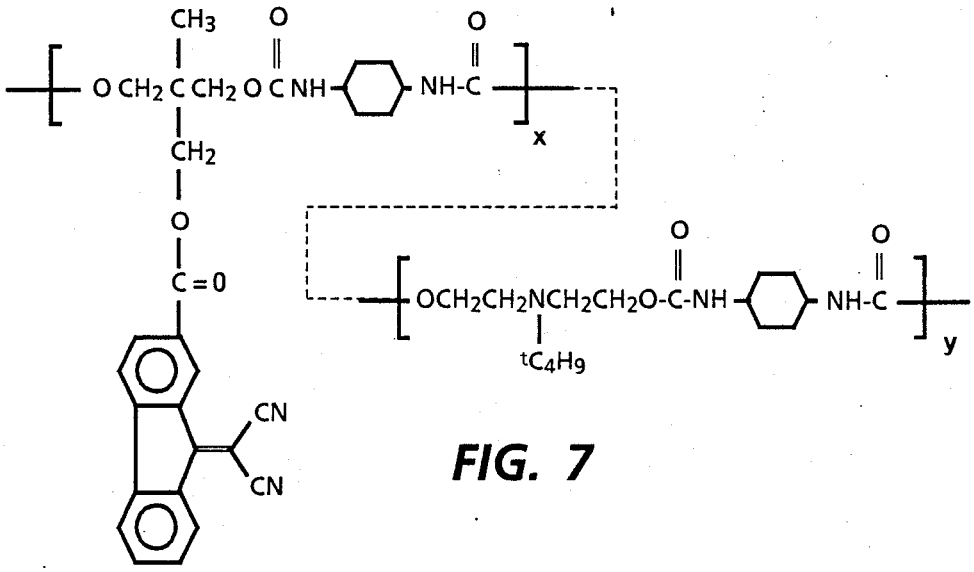

Synthesis of Copolyurethane (FIG. 6, x+0.6; y+0.4)

The synthesis of the above copolyurethane was accomplished in accordance with the procedure of Example IV with monomer (c), 1,5-pentanediol and toluene diisocyanates except that the reaction was conducted in dry dimethylformamide. The yield of the above copolyurethane was 92 percent; DP 103; Tg 107° C.; IR (KBr) 1,730; 2,222 $cm^{-1}$.

EXAMPLE IX

Figure 8:
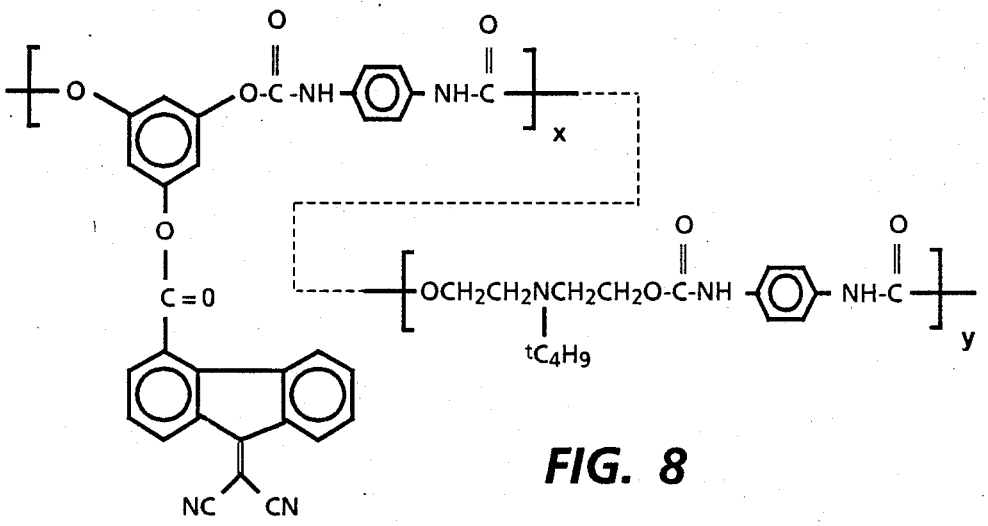
Figure 9:
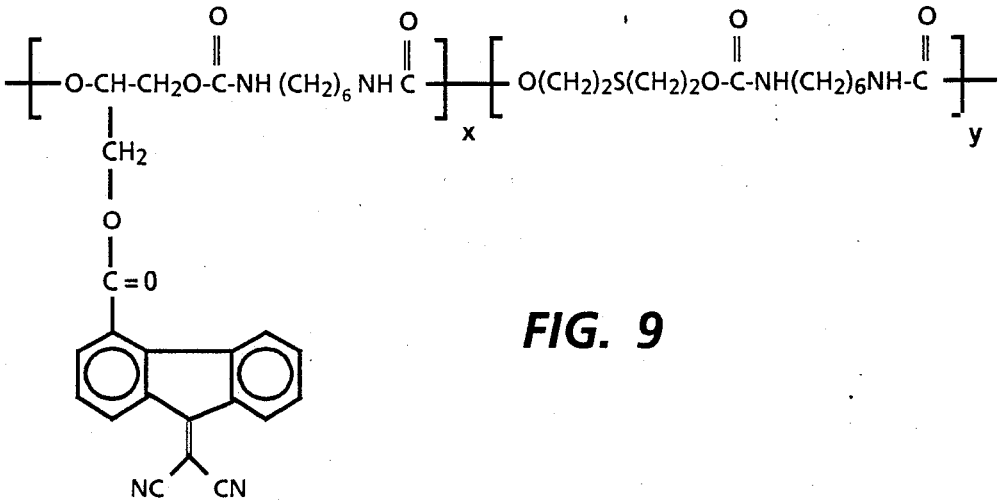
Figure 10:
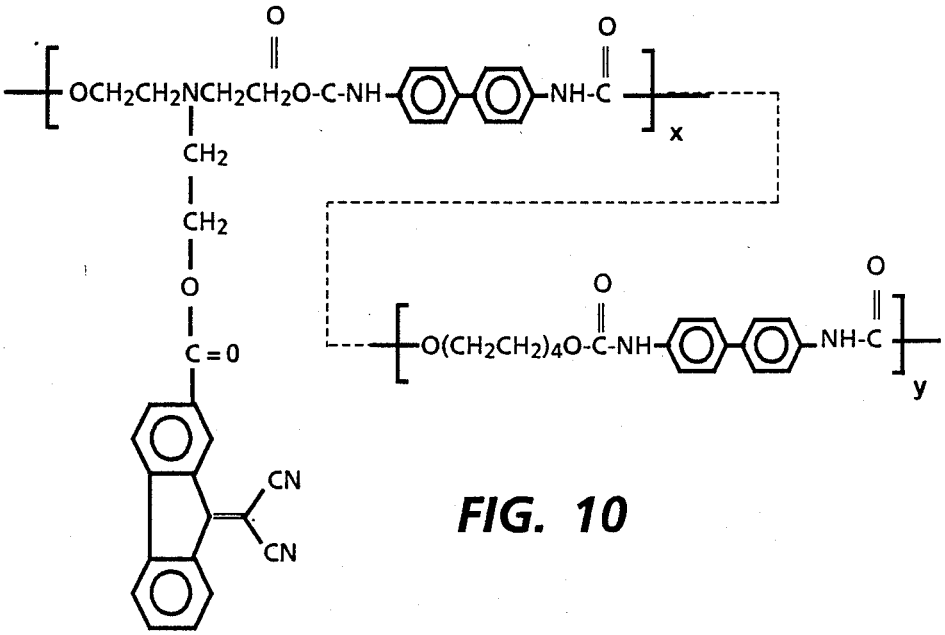

Synthesis of Copolyurethane (FIG. 8, x+0.7; y+0.3)

The synthesis of the above copolyurethane was accomplished in accordance with the procedure of Example V with 0.041 mole of diol monomer (b), 0.018 mole of t-butyl bis(2-hydroxyethyl)amine, 0.063 mole of 1,4-benzenediisocyanate, and 0.05 gram of dibutyltin dilaurate. The reaction was conducted in dried tetrahydrofuran, and the yield of the above copolyurethane was 87 percent; DP 89; Tg 138° C.; IR (KBr) 1,730; 2,222 $cm^{-1}$.

EXAMPLE X

Two substantially identical photoresponsive imaging devices were fabricated as follows. The first member was comprised of a six-layer structure with a configuration as illustrated in FIG. 11, and the second a five-layer structure without the polyurethane blocking layer to serve as a control device.

The conductive ground planes comprised of commercially available cuprous iodide were fabricated as follows: a saturated solution of cuprous iodide in butyronitrile was prepared by agitating 2.3 grams of ultra pure cuprous iodide in 100 milliliters of butyronitrile for 4 to 16 hours, followed by filtering through a filter of 0.4 micron porosity. The clear filtrate was coated by drawbar technique onto a Mylar substrate using a 6 mil bar gap. Subsequently, the ground plane coating was dried in an air convection oven at 100° C. for 10 minutes. The dry thickness of the coating was about 0.5 micron.

The upper four layers, reference FIG. 11, were coated from appropriate solutions using the above described known drawbar technique. Except for the top transport layer, each coating was dried for one hour before the subsequent layer was coated. The blocking layer of a thickness of 0.25 micron was prepared from a solution of 0.15 gram of the copolyurethane of FIG. 1 in 10 milliliters of tetrahydrofuran,a nd was coated at a thickness of about 0.2 micron using 0.5 mil bar gap. Overcoated on top of the blocking layer was a 0.06 micron thick adhesive layer which was obtained from a solution of 0.12 gram of Reillen 4200 poly(vinyl pyridine) in 20 milliliters of isobutanol and 2 milliliters of isopropanol. The photogenerating layer of trigonal selenium, about 1 micron in thickness, was obtained by coating a dispersion of 28.5 parts of trigonal selenium, 16 parts of N,N'-diphenyl-N,N'-bis(3-methylphenyl)-benzidine, 55.5 parts of poly(vinyl carbazole) in a mixture of tetrahydrofuran and toluene. The top transport layer of a thickness of 25 microns was prepared from a solution of 40 parts of N,N'-diphenyl-N,N'-bis(3-methylphenyl)benzidine and 60 parts of Makrolon polycarbonate in methylene chloride. The transport layer coating was dried at 50° C. for 30 minutes, and then at 110° C. for another 10 minutes.

The two members, one with the polyurethane blocking laye, and one without, were tested electrically by negatively charging with a corotron, and discharging by exposure to a tungsten white light. The acceptance potentials of these imaging devices after charging, and their residual potentials after exposure to white light were recorded. The surface potential was measured using a wire loop probe contained in a shielded cylinder and placed directly above the surface of the imaging device. The cylinder was grounded, and the loop was capacitively coupled to the surface potential of imaging device. The following table summarizes the electrical performance of these devices, and indicates the effective blockage of charge injection by the blocking layer:

| | ACCEPTANCE POTENTIAL (Volts) | RESIDUAL POTENTIAL (Volts) |
|---|---|---|
| WITH POLYURETHANE BLOCKING LAYER | 520 | 10 |
| WITHOUT BLOCKING LAYER | 20 | 0 |

EXAMPLE XI

A photoresponsive imaging device comprising a five-layer structure with a conductive substrate as a ground plane was fabricated by essentially repeating the procedure of Example X.

Figure 2:
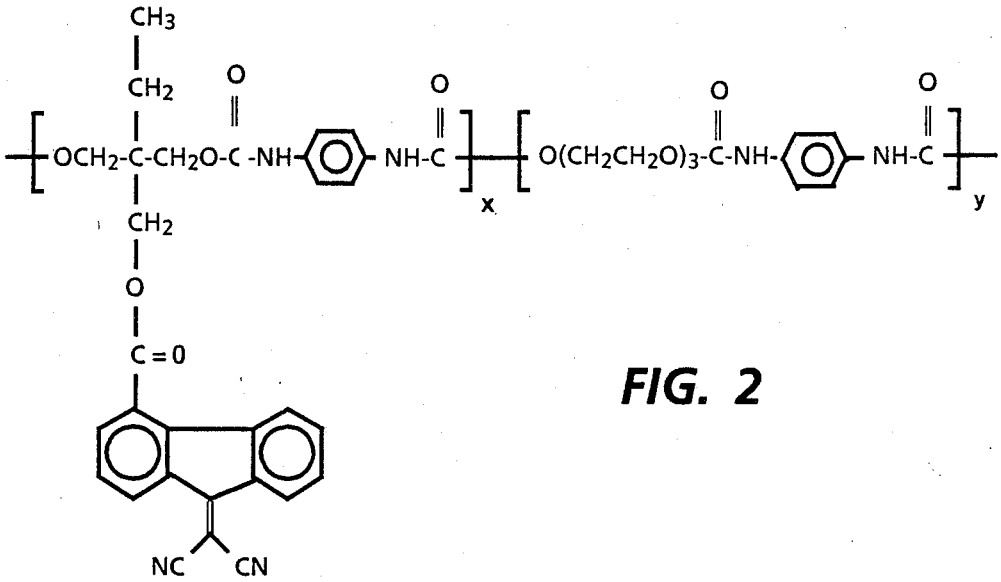

The conductive substrate was a 3 mil thick carbon black impregnated thermoplastic sheet available commercially from E. I. Dupont DeNemours, Inc. The thermoplastic was poly(vinyl fluoride) with a loading of carbon black dispersion of about 25 percent. The resistivity of this ground plane was $10^4$ ohms/square. A blocking layer of thickness of about 0.8 micron was coated on the ground plane in accordance with the procedure of Example X except that the copolyurethane of FIG. 2 was selected in place of the copolyurethane of FIG. 1. On top of the blocking layer was coated in succession a photogenerating layer, and a transport layer which were identical to those of Example X. a control imaging device without the blocking layer was also fabricated by repeating the aforementioned process.

The members (devices) were then electrically tested in a cyclic scanner for over 200 cycles. The scanner was equipped with a single wire corotron set to deposit $9\times10^{-8}$ coulombs/$cm^2$ of charge on the imaging surface. The imaging devices were wrapped around an aluminum drum with a circumference of 76.5 centimeters and rotated at a speed of 12 rpm, giving a surface speed of 6 inches per second. The devices were discharged with a tungsten white light source. The device with a blocking layer exhibited stable acceptance for over 200 cycles, and the residual potential remained at 30 to 50 volts. The acceptance potential of the control device was considerably lower and unstable after 200 cycles of charging and discharging, reference the following table.

| | ACCEPTANCE POTENTIAL (Volts) | | RESIDUAL POTENTIAL (Volts) | |
|---|---|---|---|---|
| | 1st cycle | 200th cycle | 1st cycle | 200th cycle |
| WITH | 880 | 920 | 35 | 50 |

-continued

| | ACCEPTANCE POTENTIAL (Volts) | | RESIDUAL POTENTIAL (Volts) | |
|---|---|---|---|---|
| | 1st cycle | 200th cycle | 1st cycle | 200th cycle |
| POLYURETHANE BLOCKING LAYER | | | | |
| WITHOUT BLOCKING LAYER | 420 | 330 | 32 | 36 |

EXAMPLE XII

A photoresponsive imaging member similar to Example X was prepared by repeating the procedure of this Example with a Mylar substrate, an eight-micron thick conductive layer comprising 15 percent of carbon black (Black Pearls 2000 available from Cabot Corporation) in polyester PE-49000 (from DuPont), a blocking layer of the copolyurethane of FIG. 3, an adhesive layer, a photogenerating layer, and a transport layer identical to those of Example X. The solution for the conductive layer was prepared by dispersing by agitation 0.94 gram of carbon black in a solution of 5.32 grams of polyester PE-49000 in 325 milliliters of methylene chloride. The device was electrically tested by repeating the procedure of Examples X and XI, and substantially similar results were obtained.

EXAMPLE XIII

A photoresponsive imaging member similar to that of Example XII was prepared by repeating the procedure of this Example with the exception that a ball grained aluminum plate was employed as the conductive layer instead of the carbon black impregnated polyester film. Electrical testing of the device was accomplished by repeating the procedure of Example X. Substantially similar results were obtained.

EXAMPLE XIV

A photoresponsive imaging member similar to that of Example X was prepared by repeating the procedure of this Example with the exception that a polypyrrole conductive coating was used instead of cuprous iodide. The polypyrrole conductive layer was prepared by coating a 5 percent solution of ICP-117 polypyrrole dispersion (from Polaroid Corporation) using a drawbar with a 2 mil gap opening. The coating was dried as before at 100° C. for 10 minutes. Electrical testing was accomplished in accordance with the procedure of Example X, and substantially similar results were obtained.

Although the invention has now been described with reference to specific preferred embodiments, it is not intended to be limited thereto but rather those of ordinary skill in the art will recognize that variations and modifications, including equivalents thereof, may be made therein which are within the spirit of the invention and within the scope of the claims.

What is claimed is:

1. An imaging member comprised of an optional supporting substrate; a ground plane layer; a blocking layer; an optional adhesive layer; a photogenerator layer; and a charge transport layer, wherein the blocking layer is comprised of a polyurethane of the formula:

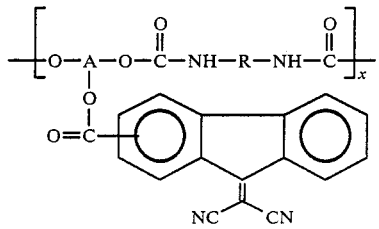

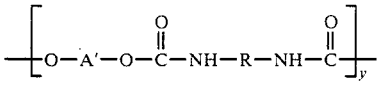

wherein A is a trivalent group; A′ is a bivalent group; R is selected from the group consisting of alkylene, substituted alkylene, arylene, and substituted arylene; x and y are number mole fractions the sum of which is equal to 1.0.

2. An imaging member in accordance with claim 1 wherein the photogenerator layer is comprised of selenium.

3. An imaging member in accordance with claim 1 wherein the photogenerator layer is comprised of a selenium alloy.

4. An imaging member in accordance with claim 3 wherein the alloy is selenium arsenic, or selenium tellurium.

5. An imaging member in accordance with claim 1 wherein the trivalent group A contains from 4 to about 20 carbon atoms.

6. An imaging member in accordance with claim 1 wherein A is 2,2-dimethylene butyl, 2,2-dimethylene propyl, 2,2-dimethylene ethyl, or triethylene amine.

7. An imaging member in accordance with claim 1 wherein the blocking layer is of a thickness of from about 0.01 to about 2 microns.

8. An imaging member in accordance with claim 1 wherein the blocking layer is of a thickness of from about 0.1 to about 5 microns.

9. An imaging member in accordance with claim 1 wherein R is an arylene group of from 6 to about 24 carbon atoms.

10. An imaging member in accordance with claim 1 wherein R is a alkylene group of from 1 to about 20 carbon atoms.

11. An imaging member in accordance with claim 1 wherein R is hexamethylene, phenylene, or tolylene.

12. An imaging member in accordance with claim 1 wherein the bivalent group A′ contains heteroatoms selected from the group consisting of nitrogen, oxygen, and sulfur.

13. An imaging member in accordance with claim 1 wherein A′ is $-CH_2CH_2OCH_2CH_2-$; $-CH_2CH_2OCH_2CH_2OCH_2CH_2-$; $-CH_2CH_2N(t\text{-}C_4H_9)CH_2CH_2-$; or $-CH_2CH_2SCH_2CH_2-$.

14. An imaging member in accordance with claim 1 wherein A′ is $-(CH_2)n-$ wherein n is a number of from about 2 to about 20.

15. An imaging member in accordance with claim 1 wherein the polyurethane is selected from the group consisting of those represented by the formulas of FIGS. 1, 2, 3, 4, 5, 6, 7, 8, 9, and 10, wherein x and y are number mole fractions the sum of which is equal to 1.0.

16. An imaging member in accordance with claim 1 containing a conductive or polymeric supporting substrate.

17. An imaging member in accordance with claim 1 wherein the photogenerating layer is comprised of a photogenerating pigment optionally dispersed in a resinous binder, and the transport layer is comprised of an aryl amine hole transport material dispersed in a resinous binder.

18. An imaging member in accordance with claim 17 wherein the photogenerating pigment is selected from the group consisting of metal phthalocyanines; metal free phthalocyanines; vanadyl phthalocyanine; and trigonal selenium.

19. An imaging member in accordance with claim 1 wherein the charge transport layer contains molecules of the formula

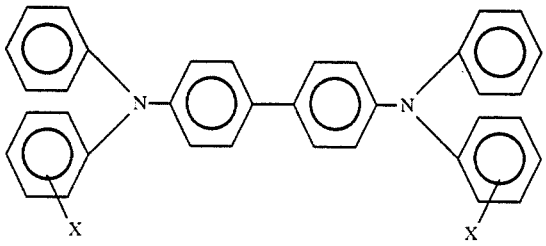

wherein X is an alkyl group, or halogen atom.

20. An imaging member in accordance with claim 19 wherein the polyurethane blocking layer is represented by the formulas of FIGS. 1, 2, 3, 4, 5, 6, 7, 8, 9, and 10, wherein x and y are number mole fractions the sum of which is equal to 1.0.

21. An imaging layer in accordance with claim 1 containing an adhesive layer.

22. An imaging layer in accordance with claim 21 wherein the adhesive layer is selected from the group consisting of polyesters, phenoxy resins, vinyl polymers, and silicon polymers.

23. An imaging layer in accordance with claim 17 containing a polymeric adhesive layer.

24. An imaging layer in accordance with claim 23 wherein the adhesive layer is selected from the group consisting of polyesters, phenoxy resins, vinyl polymers, and silicon polymers.

25. An imaging member comprised of a ground plane layer; a blocking layer; a photogenerator layer; and a charge transport layer, wherein the blocking layer is comprised of a polyurethane of the formula:

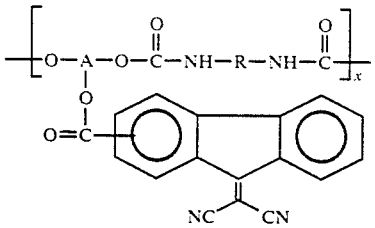

-continued

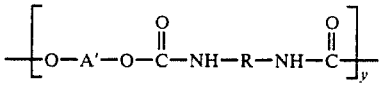

wherein A is a trivalent group; A' is a bivalent group; R is selected from the group consisting of alkylene, substituted alkylene, arylene, and substituted arylene; x and y are number mole fractions the sum of which is equal to 1.0.

26. An imaging layer in accordance with claim 25 wherein the polyurethane blocking layer is represented by the formulas of FIGS. 1, 2, 3, 4, 5, 6, 7, 8, 9 and 10.

27. An imaging layer in accordance with claim 1 wherein x and y are mole fraction numbers of from about 0.05 to about 0.95.

28. An imaging layer in accordance with claim 25 wherein x and y are mole fraction numbers of from about 0.05 to about 0.95.

29. An imaging layer in accordance with claim 1 wherein the adhesive layer is of a thickness of from about 0.05 micron to about 5 microns.

30. An imaging layer in accordance with claim 25 containing a supporting substrate.

31. An imaging member comprised of a ground plane layer; a blocking layer; a photogenerator layer; and a charge transport layer, wherein the blocking layer is comprised of a polyurethane of the formula of claim 1; wherein A is a trivalent group selected from the group consisting of dialkylene alkyl and trialkylene amine; A' is a bivalent group selected from the group consisting of alkylene, arylene, polyether segments, and the derivatives thereof; R is selected from the group consisting of alkylene, substituted alkylene, arylene, and substituted arylene; and x and y are number mole fractions the sum of which is equal to 1.0.

32. An imaging member in accordance with claim 31 containing a supporting substrate.

33. An imaging member in accordance with claim 31 containing an adhesive layer.

34. An imaging member in accordance with claim 33 wherein the adhesive layer is situated between the photogenerating layer and the blocking layer.

35. An imaging member in accordance with claim 31 wherein the polyurethane is selected from the group consisting of those compounds represented by the formulas of FIGS. 1, 2, 3, 4, 5, 6, 7, 8, 9 and 10, wherein x and y are number mole fractions the sum of which is equal to 1.0.

36. An imaging member in accordance with claim 31 wherein x and y are mole fraction numbers of from about 0.05 to about 0.95.

37. An imaging member in accordance with claim 31 wherein the photogenerating layer is situated between the blocking layer and the charge transport layer.

38. An imaging member in accordance with claim 1 wherein the blocking layer is situated between the ground plane and the adhesive layer.

39. An imaging member in accordance with claim 25 wherein the blocking layer is in contact with the photogenerating layer and wherein the photogenerating layer is situated between the blocking layer and the charge transport layer.

* * * * *